US009175682B2

(12) United States Patent
Kerlin

(10) Patent No.: US 9,175,682 B2
(45) Date of Patent: Nov. 3, 2015

(54) PLANETARY ROTOR MACHINE MANIFOLD

(71) Applicant: Jack Kerlin, Vancouver, WA (US)

(72) Inventor: Jack Kerlin, Vancouver, WA (US)

(73) Assignee: Helidyne LLC, Washington, UT (US)

( * ) Notice: Subject to any disclaimer, the term of this patent is extended or adjusted under 35 U.S.C. 154(b) by 107 days.

(21) Appl. No.: 14/160,251

(22) Filed: Jan. 21, 2014

(65) Prior Publication Data

US 2014/0255232 A1 Sep. 11, 2014

Related U.S. Application Data

(60) Provisional application No. 61/775,224, filed on Mar. 8, 2013.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 15/06*** | (2006.01) |
| ***F04C 18/16*** | (2006.01) |
| ***F01C 21/10*** | (2006.01) |
| ***F01C 1/20*** | (2006.01) |
| ***F01C 21/08*** | (2006.01) |
| ***F04C 2/16*** | (2006.01) |

(52) U.S. Cl.

CPC . *F04C 15/06* (2013.01); *F01C 1/20* (2013.01); *F01C 21/08* (2013.01); *F01C 21/10* (2013.01); *F04C 2/165* (2013.01); *F04C 18/165* (2013.01); *F04C 2250/101* (2013.01); *F04C 2250/20* (2013.01)

(58) Field of Classification Search

CPC ..... F04C 2/165; F04C 15/06; F04C 18/165; F04C 2250/20; F04C 2250/101; F01C 1/20; F01C 21/108; F01C 21/10

USPC ..... 418/15, 196–197, 183, 186–188; 123/246

See application file for complete search history.

(56) References Cited

U.S. PATENT DOCUMENTS

| | | | |
|---|---|---|---|
| 710,756 | A | 10/1902 | Colbourne |
| 1,349,882 | A | 8/1920 | Homan |
| 2,097,881 | A | 11/1937 | Hopkins |

(Continued)

OTHER PUBLICATIONS

ISA Korean Intellectual Property Office, International Search Report and Written Opinion of PCT/US2014/069399, WIPO, Mar. 31, 2015, 10 pages.

*Primary Examiner* — Theresa Trieu

(74) *Attorney, Agent, or Firm* — Alleman Hall McCoy Russell & Tuttle LLP

(57) ABSTRACT

Various apparatuses are provided for planetary rotor machines including a plurality of helical rotors and a corresponding manifold. In one example, the manifold includes a head plate to which each of the rotors is rotatably mounted. The head plate includes a fluid flow opening having a center coaxial with a central axis of the machine. The fluid flow opening comprises a plurality of ports that each correspond to one of the rotors. Each of the ports comprises an inwardly curving inner side extending between a starting point and an ending point, a first lateral arcuate side that forms with the inner side a first pointed notch in the head plate, and a second lateral arcuate side that forms with the inner side a second pointed notch in the head plate. The second lateral arcuate side is a mirror image of the first lateral arcuate side. The manifold substantially prevents fluid from bypassing a cavity created by the rotors of the machine.

20 Claims, 14 Drawing Sheets

(56) References Cited

U.S. PATENT DOCUMENTS

| | | | | | |
|---|---|---|---|---|---|
| 2,410,341 | A | | 10/1946 | Delamere | |
| 3,234,888 | A | | 2/1966 | Wise et al. | |
| 3,439,654 | A | | 4/1969 | Campbell, Jr. | |
| 3,809,026 | A | | 5/1974 | Snyder | |
| 3,966,371 | A | | 6/1976 | Berzanske | |
| 3,990,410 | A | * | 11/1976 | Fishman | 418/196 |
| 4,782,802 | A | | 11/1988 | Koromilas | |
| 4,877,385 | A | * | 10/1989 | Koromilas | 418/197 |
| 4,926,642 | A | | 5/1990 | Buthmann et al. | |
| 4,934,325 | A | * | 6/1990 | Snyder | 418/196 |
| 5,271,364 | A | * | 12/1993 | Snyder | 418/196 |
| 5,341,782 | A | * | 8/1994 | McCall et al. | 418/196 |
| 6,139,290 | A | | 10/2000 | Masterson | |
| 6,296,462 | B1 | | 10/2001 | Driver et al. | |
| 8,037,862 | B1 | | 10/2011 | Jacobs | |
| 8,356,585 | B2 | | 1/2013 | Hathaway et al. | |

* cited by examiner

PLANETARY ROTOR MACHINE MANIFOLD

CROSS REFERENCE TO RELATED APPLICATIONS

This application claims priority to U.S. Provisional Patent Application Ser. No. 61/775,224, filed on Mar. 8, 2013 and entitled PLANETARY ROTOR MACHINE, the entirety of which is hereby incorporated by reference for all purposes.

FIELD

The present disclosure relates generally to the field of planetary rotor machines.

BACKGROUND

Multi-rotor planetary rotor machines may be utilized as positive displacement devices in a variety of applications. A planetary rotor machine typically employs 3 or 4 rotors equally disposed around a central machine axis. All of the rotors have the same shape and rotate in the same direction. Together, the multiple rotors cooperative to form an internal working volume, or cavity, bounded by the rotors themselves.

Planetary rotor machines utilize rotors having lobes with an axial helical twist to create an internal "progressive cavity" that conducts fluid along the machine axis in a manner similar to a screw auger. Fluid is introduced at one end of the rotor assembly from a first pressure regime, and is transported by the rotor-formed cavity to the opposite end for discharge into a different pressure regime. In this manner the planetary rotor machine either produces or extracts shaft power.

In a planetary rotor machine, the mutually engaging planetary rotors constitute the radial walls of the progressive cavity, without requiring an external housing. Axial walls of the cavity are provided by flat, stationary head plates, or "manifolds", that abut opposite ends of the rotor assembly. In this manner, and unlike conventional twin screw machines, planetary rotor machines do not require a precision encasement surrounding the rotor assembly. Rather, the cavities are formed by the meshing rotors in cooperation with the flat manifolds abutting the rotor ends.

The general concept of using planetary rotor machines for positive displacement applications has been proposed; however, in practice certain challenges have prevented the commercial adoption of such machines. For example, with some rudimentary manifold configurations, such as a single circular fluid entry opening or port, at certain angular orientations of the rotors pressurized fluid at the manifold-rotor junction may bypass the cavity entirely and flow freely around the outside of the rotors. Such escaping fluid may significantly comprise the efficiency of the planetary rotor machine, and thereby constrain or eliminate the functional and/or commercial viability of such machines. Conversely, sizing a fluid entry port at the manifold-rotor junction too conservatively creates an internal pressure drop and loss of operating efficiency.

One prior attempt to address the problem of manifold-rotor fluid traversal is found in U.S. Pat. No. 3,234,888, which discloses a four-rotor rotary pump enclosed in a rotor casing. A complex valving arrangement utilizes separate rotatable valve "plates" that are mounted on each rotor shaft. Each rotatable valve plate mates with a corresponding stationary portal to channel fluid into the cavity at the correct rotor angular orientation. Such a configuration, however, is ill-suited for a planetary rotor machine that does not utilize an external housing, and further introduces manufacturing and design complexities as well as moving parts that require precision tolerances.

SUMMARY

Embodiments that relate to a manifold for a planetary rotor machine having plurality of helical rotors are provided. In one embodiment, a manifold for a planetary rotor machine includes a head plate to which each of the plurality of rotors is rotatably mounted. The head plate includes a fluid flow opening having a center coaxial with a central axis of the planetary rotor machine. The fluid flow opening comprises a plurality of ports with each of the ports corresponding to one of the helical rotors.

Each of the ports is defined by an inwardly curving inner side extending between a starting point and an ending point. A first lateral arcuate side extends from the starting point of the inner side and together with the inner side a first pointed notch in the head plate. A second lateral arcuate side extends from the ending point of the inner side and together with the inner side forms a second pointed notch in the head plate. The second lateral arcuate side is a mirror image of the first lateral arcuate side. The manifold substantially prevents fluid from bypassing a cavity created by the rotors.

Another embodiment relates to a manifold for introducing a fluid into or discharging a fluid from a planetary rotor machine, where the planetary rotor machine comprises 4 helical rotors that create a cavity for compressing or expanding the fluid. The manifold comprises a head plate including a fluid flow opening having a center coaxial with a central axis of the planetary rotor machine. The fluid flow opening comprises 4 ports that each correspond to one of the rotors.

Each of the ports includes an inwardly curving inner side that extends between a starting point and an ending point. A first lateral arcuate side extends from the starting point of the inner side and forms an acute angle with the inner side. A second lateral arcuate side extends from the ending point of the inner side and forms an acute angle with the inner side. The second lateral arcuate side is a mirror image of the first lateral arcuate side. The manifold substantially prevents the fluid from bypassing the cavity created by the rotors.

Another embodiment relates to a planetary rotor machine for compressing or expanding a fluid. The planetary rotor machine comprises a core extending along a central axis of the machine and coaxial with the central axis. A plurality of helical rotors are positioned around the core, with the helical rotors creating a cavity around the core in which the fluid travels. A manifold is provided for introducing the fluid into the cavity or discharging the fluid from the cavity.

The manifold comprises a head plate including a fluid flow opening having a center coaxial with the central axis of the planetary rotor machine. The fluid flow opening comprises a plurality of ports with each of the ports corresponding to one of the helical rotors. Each of the ports comprises an inwardly curving inner side extending between a starting point and an ending point. A first lateral arcuate side extends from the starting point of the inner side and forms an acute angle with the inner side. A second lateral arcuate side extending from the ending point of the inner side and forms an acute angle with the inner side. The second lateral arcuate side is a mirror image of the first lateral arcuate side. The manifold substantially prevents the fluid from bypassing the cavity created by the rotors.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

The present disclosure will be better understood from reading the following description of non-limiting embodiments with reference to the attached drawings, wherein.

DETAILED DESCRIPTION

Figure 1:
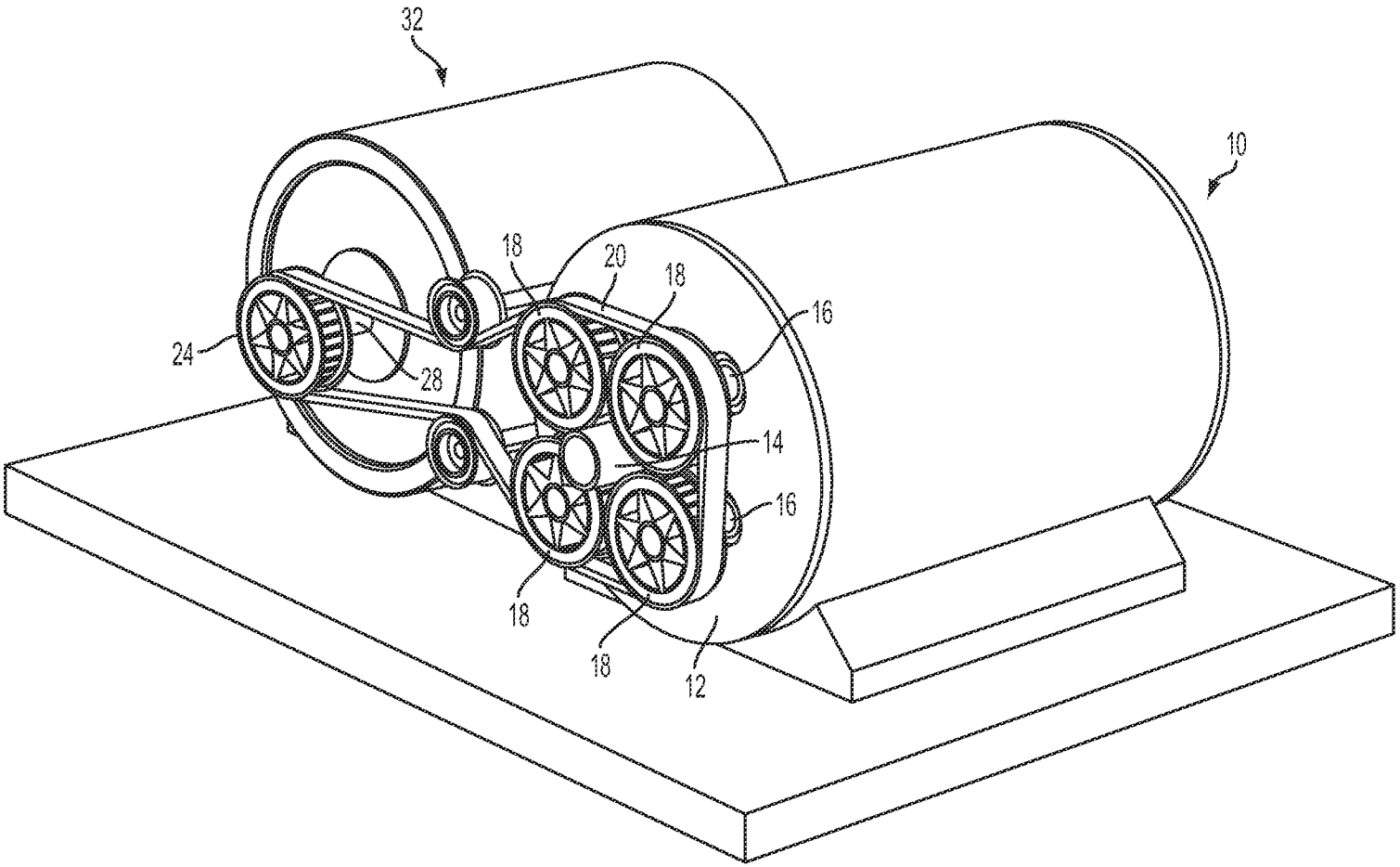
FIG. 1 shows a perspective view of an embodiment of a planetary rotor machine that includes a manifold according to an embodiment of the present disclosure.

FIG. 1 shows a schematic illustration of an embodiment of a planetary rotor machine 10 that includes an entry manifold 12 for introducing a fluid into the machine according to the present disclosure. The planetary rotor machine 10 may be utilized for a variety of positive displacement applications in which a fluid is compressed or expanded within a cavity created by the helical rotors of the machine. In the example embodiment of FIG. 1, the planetary rotor machine 10 includes 4 helical rotors (not shown) and an intake pipe 14 for introducing fluid into the machine through the entry manifold 12. Advantageously and as described in more detail below, the entry manifold 12 substantially prevents the fluid from bypassing the cavity created by the rotors of the machine.

Each rotor is coupled to a shaft 16 that extends from the machine. A timing pulley 18 mounted to each shaft 16 engages a timing belt 20 to synchronize the rotation of the rotors. In this example, the timing belt 20 also drives a generator pulley 24 coupled to a shaft 28 of an adjacent generator 32. In this manner, the planetary rotor machine 10 receives pressurized fluid via the intake pipe 14 to drive rotation of the helical rotors and produce shaft power, which in turn drives rotation of the shaft 28 of generator 32. Such fluid may be discharged through an exit manifold (not shown) at the rear of the machine 10.

FIGS. 2-9 illustrate an embodiment of a four-rotor planetary rotor machine 200 that includes an entry manifold 204 for introducing a fluid into the machine at a rotor end/head plate juncture according to the present disclosure. With reference to these figures, a description of the operation of the planetary rotor machine 200 will now be provided. As noted above, a planetary rotor machine is a type of rotary positive displacement device employing multiple helical rotors equally disposed around a central machine axis. The spatial arrangement of the rotors uniformly disposed around a central axis is reminiscent of planet and sun gears in a planetary transmission. Additionally and in contrast to a twin screw machine, for example, all rotors of the planetary machine rotate in the same direction.

Figure 2:
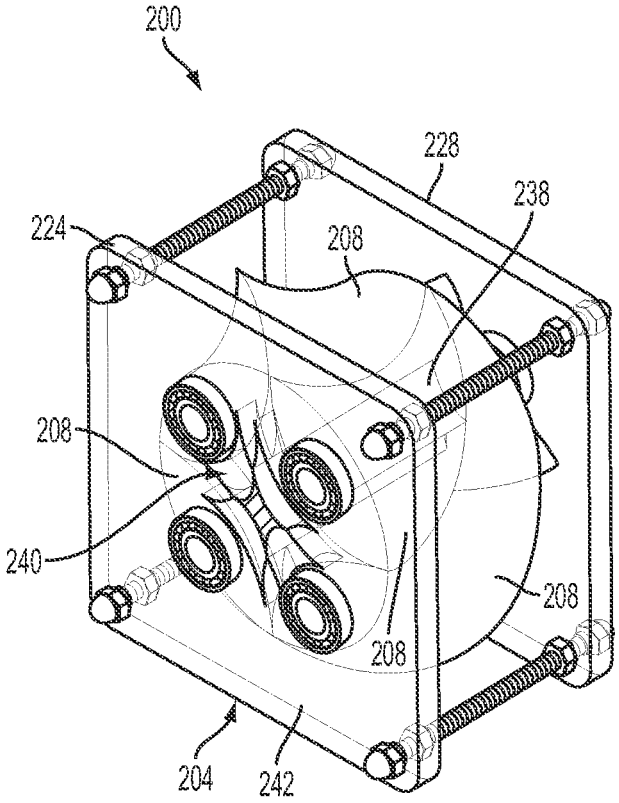
FIG. 2 shows a perspective view of another embodiment of a planetary rotor machine including a manifold according to an embodiment of the present disclosure.
Figure 3:
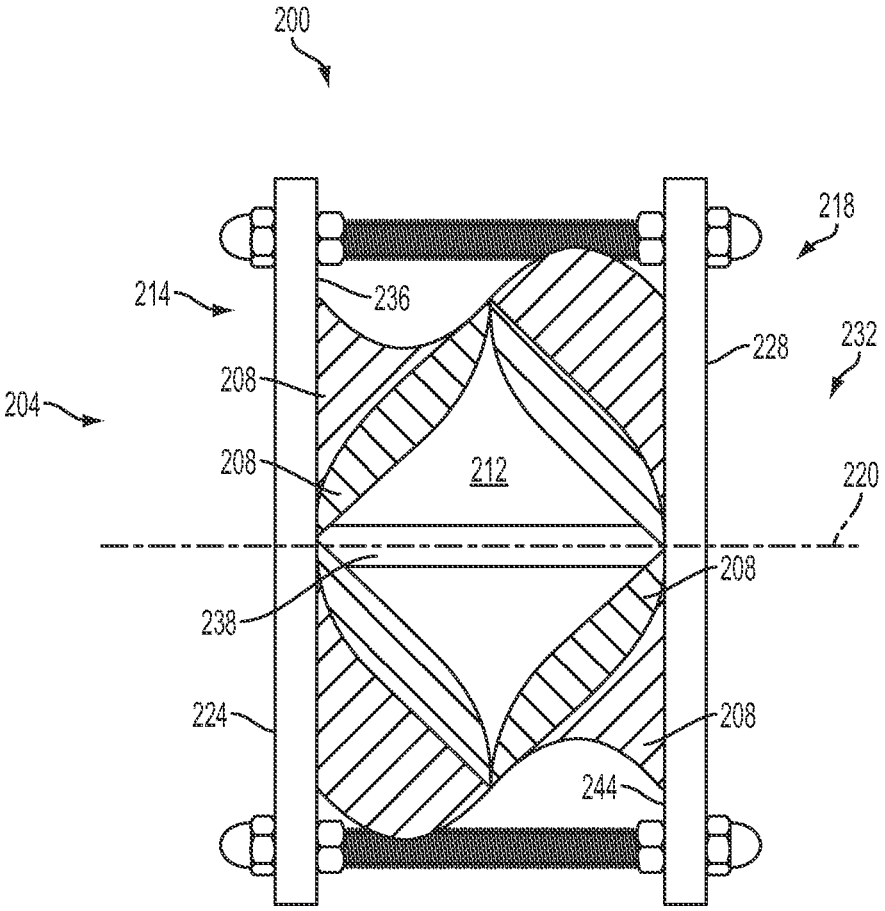
FIG. 3 shows a partial cut away side view of the planetary rotor machine of FIG. 2

With reference to FIGS. 2 and 3, planetary rotor machine 200 utilizes 4 helical screw rotors 208. As the rotors 208 rotate, the space enclosed between the meshing rotors 208 forms a cavity 212 that progresses axially during rotor rotation due to the helical axial twist of the rotor lobes. As the cavity 212 progresses it forms a varying volume that is bounded by the rotors 208 themselves. This progressive cavity transports fluid (gas or liquid) along the machine center axis 220 like a screw auger. A minimum helical twist of 180° may be utilized for a 4-rotor machine and a minimum helical twist of 120° may be utilized for a 3-rotor machine, as described in more detail below. A 4-rotor machine produces two complete volume cycles per revolution. A 3-rotor machine produces three complete volume cycles per revolution.

Fluid inducted at an entry end 214 of the machine 200 travels inside the rotor-formed cavity along the machine center axis 220 to the opposite, exit end 218 where it discharges into a higher pressure region for a compressor, or into a lower pressure region for an expander. Accordingly, the process produces shaft power in an expander or extracts shaft power in a compressor.

Unlike a twin screw machine, no external housing is required for the planetary rotor machine 200. Rather, the mutually engaging planetary rotors 208 constitute the primary cavity walls. A flat entry head plate 224 of the entry manifold 204 and a flat exit head plate 228 of an exit manifold 232 function as cavity walls at the axial ends of the rotors 208. Leakage of fluid from the cavity is partially controlled by a precision running clearance between the flat inner surface 236 of the entry manifold 204 and the planar ends of the rotors 208 at that surface, and a similar precision running clearance between the flat inner surface 244 of the exit manifold 232 and the planar ends of the rotors 208 at that surface.

As described in more detail below and shown in FIGS. 2, 3, 5 and 6, a solid core 238 extends co-axially with the machine center axis 220 through the cavity 212 created by the rotors 208. The core 238 corresponds to a minimum cavity area that occurs when the major axes of all four rotors 208 orient radially with respect to the machine center, as shown in FIG. 6. Alternatively expressed, the core 238 is configured and sized to occupy substantially all of the volume between the 4 rotors when the rotors are oriented to minimize the volume of the cavity as shown in FIG. 6. It will also be appreciated that the cross-sectional area of the solid core 238 formed by the converging rotor tips does not directly participate in machine function. As shown for example in FIGS. 2 and 6, the core 238 may comprise a solid, symmetric, 4-sided rod having opposing, sides that are mirror images of one another. At least two partial cavities are formed along the rotor length at any given instant. Thus it will be appreciated that the primary function of core 238 is to prevent axial leakage between successive cavities 212.

Figure 4:
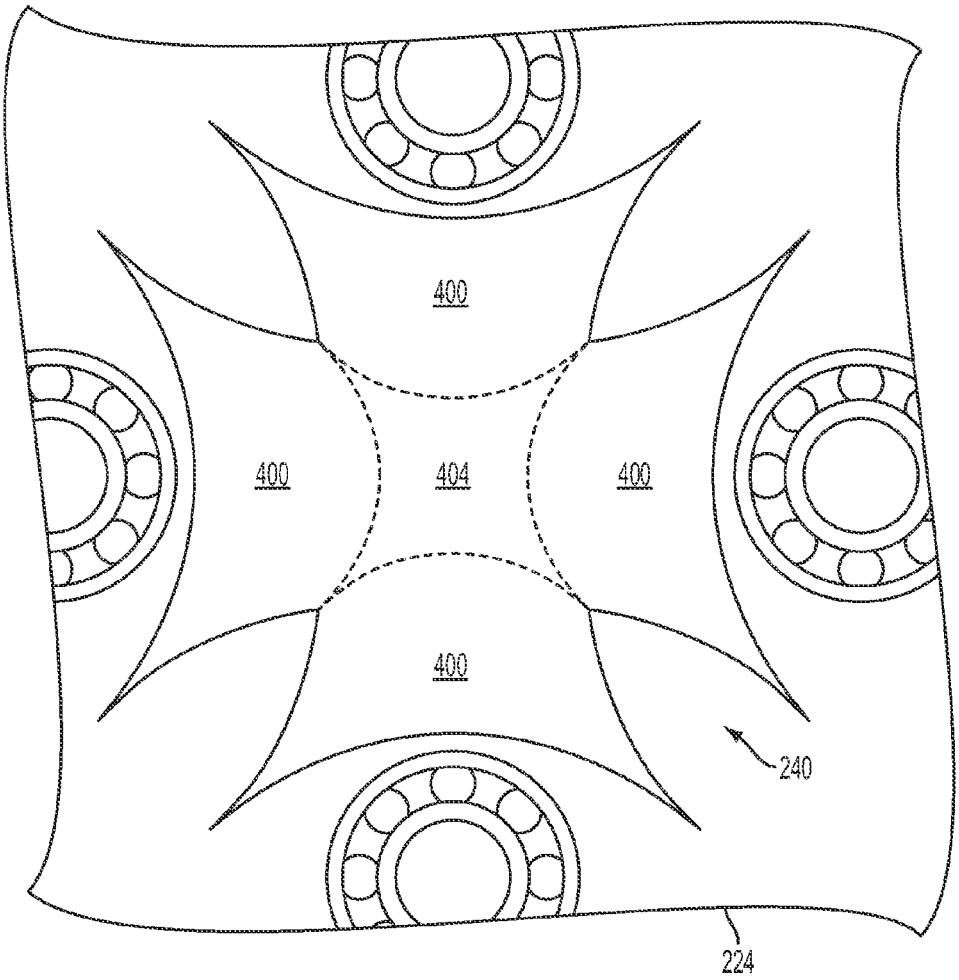
FIG. 4 shows a cut away front view of the manifold of FIG. 2 showing a portion of the head plate that includes a fluid flow opening comprising a plurality of ports.

As noted above, manifolds in some prior planetary rotor machines include fluid entry ports that allow pressurized fluid at the manifold-rotor juncture to bypass the internal cavity entirely and flow freely around the outside of the rotors at certain rotor angular positions. This intrinsic design flaw of these machines renders them impractical and of limited commercial potential. Advantageously and as best seen in FIG. 4 and described in more detail below, in one embodiment of the present disclosure an entry manifold 204 includes a fluid flow opening 240 in the entry head plate 224, with the opening comprising plurality of ports 400 that are configured to prevent fluid from bypassing the internal cavity of the planetary rotor machine 200, regardless of rotor angular position. Further, the geometry of the ports 400 is specifically designed to cooperate with the geometry and configuration of the machine rotors to maximize fluid flow into the cavity while also preventing the above-referenced fluid bypass.

With reference now to FIG. 4, a portion of the entry head plate 224 including the fluid flow opening 240 is illustrated. As described in more detail below, the fluid flow opening 240 includes four identically shaped ports 400 that are located circumferentially around a central aperture 404, such that each port 400 corresponds to one of the four helical rotors 208 of the planetary rotor machine 200. The geometric configuration of each port 400 is mathematically based on the cross-sectional geometry of the four helical rotors 208 and the relative location of the rotors' rotational axes around the machine center axis 220 of the planetary rotor machine 200. In this manner, each of the 4 ports cooperates with the rotors 208 to substantially prevent fluid from bypassing the cavity 212 while also maximizing fluid flow into the cavity.

As best seen in FIG. 4, the four ports 400 and central aperture 404 comprise the fluid flow opening 240 in the head plate 224 of the entry manifold 204. It will also be appreciated that the cross-sectional profile of the central aperture 404 approximately matches the cross-sectional profile of the core 238 (see also FIG. 6). In this manner and in some embodiments, an axial end of the core 238 may be received within the central aperture 404 of the fluid flow opening 240 and may be flush with the outer surface 242 of the head plate 224 as shown in FIG. 2. In other embodiments the axial end of the core 238 within the central aperture 404 of the fluid flow opening 240 may be recessed from the outer surface 242 of the head plate 224.

It will be appreciated that in some embodiments of the planetary rotor machine 200, the exit manifold 232 may have the same configuration as the entry manifold 204. In other embodiments, the exit manifold 232 may have a configuration different from the entry manifold 204.

Figure 5:
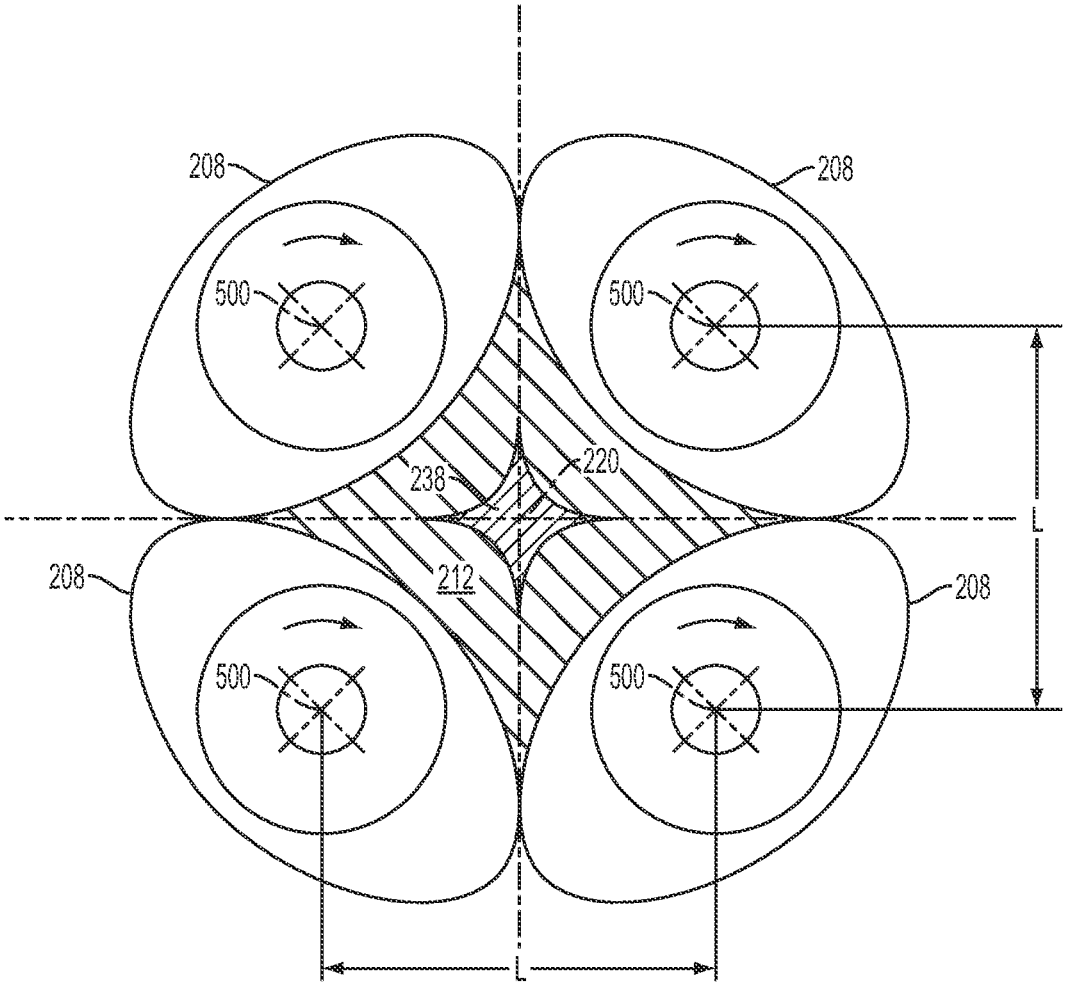
FIG. 5 shows a partial cut away end view of the planetary rotor machine of FIG. 2 with the head plate removed and showing an orientation of the 4 rotors in which the cavity volume is maximized around a core of the machine.
Figure 6:
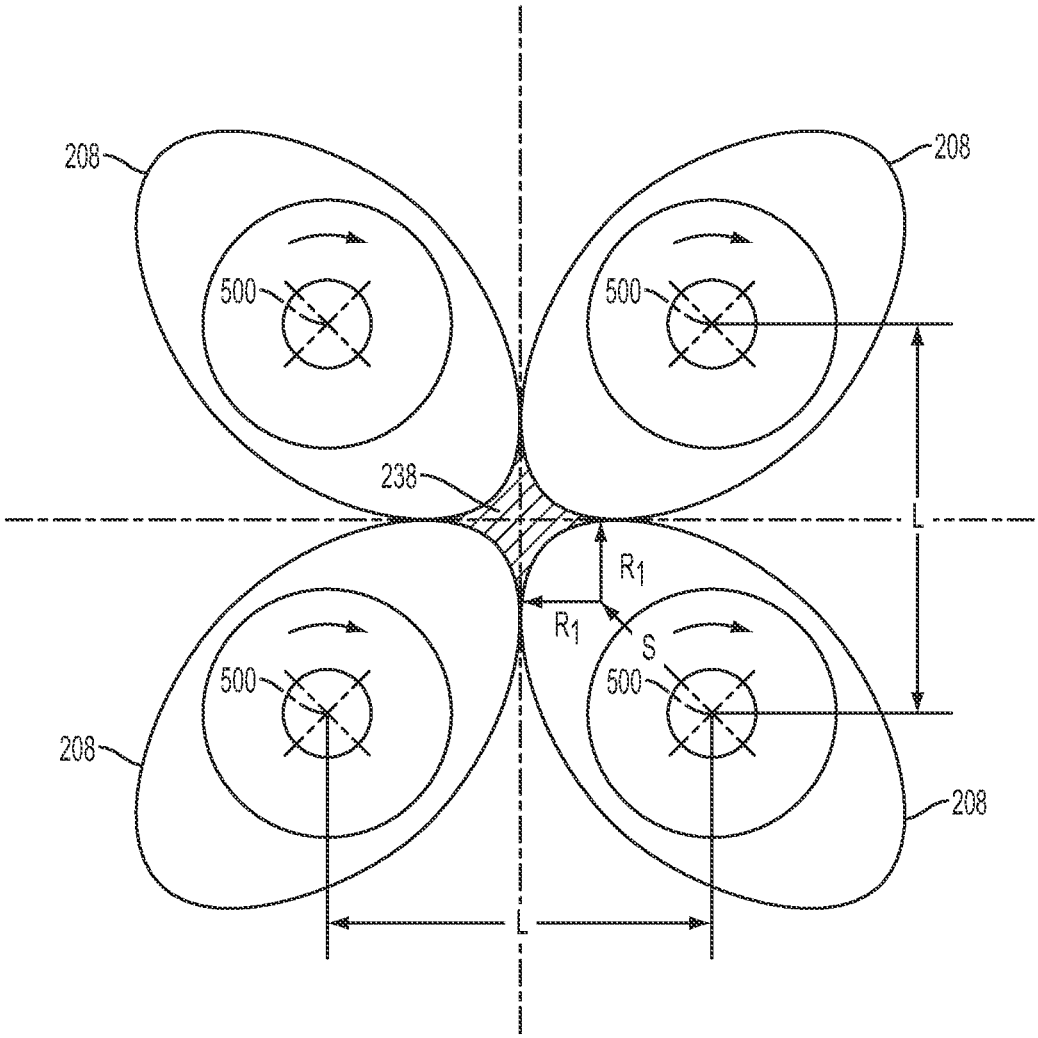
FIG. 6 shows partial cut away end view of the planetary rotor machine of FIG. 2 with the head plate removed and showing another orientation of the 4 rotors in which the cavity volume is minimized around the core of the machine.

As shown in FIGS. 5 and 6, the rotational axes 500 of the rotors 208 in the 4-rotor machine 200 are positioned relative to one another at the four corners of a square having side lengths of L. The geometric center of the square corresponds to the machine center axis 220 as shown in FIG. 5. It will be appreciated that precision rotor engagement depends upon an accuracy of the rotor shaft positions at the four corners of the square, in addition to symmetrical precision of rotor surfaces about the rotor rotational axes 500.

Figure 7:
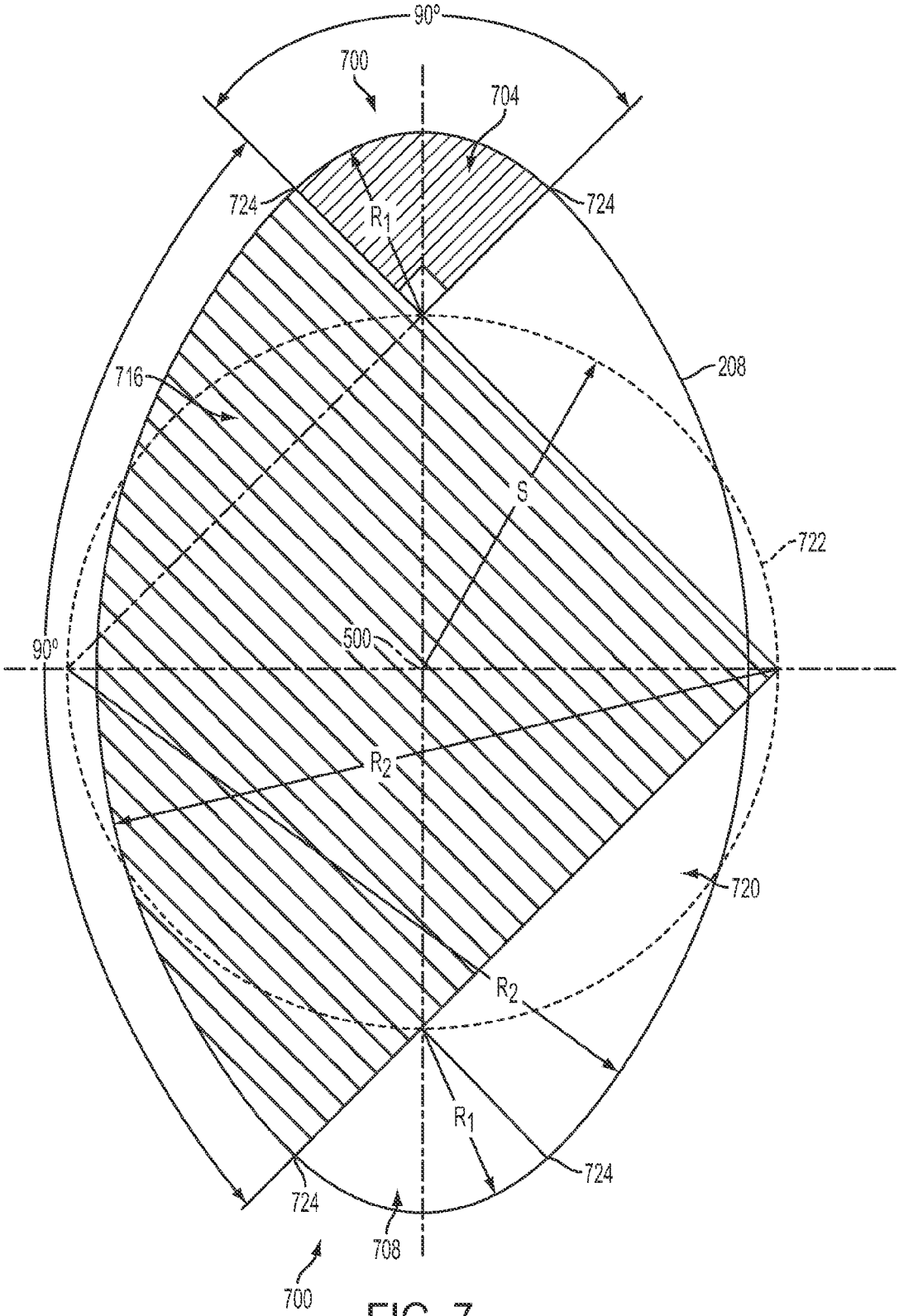
FIG. 7 shows a transverse cross-sectional view, approximately to scale, of one of the 2-lobed rotors of the 4-rotor planetary rotor machine of FIG. 2.

FIG. 5 illustrates a maximum cross-sectional area of cavity 212 that occurs when all of the rotors 208 have rotated 90° from the radial orientation of minimum area depicted in FIG. 6. With reference now to FIG. 7, a description of the lobe tips 700 and body geometry of each 2-lobed rotor 208 will now be provided. It will be appreciated that the basic principles of rotor and port design of the present disclosure apply equally to 2-lobed rotors in a 4-rotor planetary rotor machine and to 3-lobed rotors a 3-rotor planetary rotor machine. For either a 4-rotor configuration or a 3-rotor configuration, rotor tips never interact with one another nor do rotor bodies mutually mesh. Instead, rotor tips interact with bodies of adjacent rotors, and rotor bodies interact with rotor tips of adjacent rotors in all rotor positions.

As shown in FIG. 7, each of the rotors 208 has a cross sectional profile that includes two opposed lobes spaced along the longitudinal axis of the rotor profile. The cross-sectional view of 2-lobed rotor 208 shown in FIG. 7 illustrates four quarter-circular quadrants of the rotor profile—two tip quadrants 704 and 708 of tip radius $R_1$, and two body quadrants 716 and 720 of body radius $R_2$. Body quadrants and tip quadrants alternate at 90° intervals around the rotational axis 500 of the rotor 208. For clarity of illustration and description, only one tip quadrant 704 and one body quadrant 716 are shaded in FIG. 7. It will be appreciated that the second tip quadrant 708 has a shape identical to the first tip quadrant 704 and is located at the opposite lobe of the rotor 208. Similarly, the second body quadrant 720 has a shape identical to the first body quadrant 716, with portions of the second body quadrant 720 overlapping portions of the first body quadrant 716.

The circular arcs defining the body surfaces and the tip surfaces have their radii (tip radius $R_1$ and body radius $R_2$) emanating from the dotted circle 722 of radius S that is concentric to the rotor rotational axis 500. As shown in FIG. 7, tip radii $R_1$ and body radii $R_2$ are separately distinguished by different origins on the dotted circle of radius S. More particularly, tip radii $R_1$ originate at 12:00 and 6:00 positions on the dotted circle, while body radii $R_2$ originate at 9:00 and 3:00 positions on the same dotted circle. Tip surfaces and body surfaces merge seamlessly at their 4 junction points 724 where surface tangents coincide.

Three parameters may characterize the profile of rotor 208:

1) The circle 722 of radius S upon which tip radii $R_1$ and body radii $R_2$ originate;

2) Tip radius $R_1$ centered on the circle 722 of radius S at the 12:00 and 6:00 positions of the circle; and 3) Body radius $R_2$ centered on the circle 722 of radius S at the 9:00 and 3:00 positions of the circle.

Absolute values of S, $R_1$, and $R_2$ depend upon the spacing L between the rotational axes 500 of the rotors 208 as shown in FIGS. 5 and 6. For example, the inventor of the present disclosure has derived the following relationship among these variables:

$$\frac{L}{2} = \left(\frac{S}{\sqrt{2}} + R_1\right) \quad \text{Eq. 1}$$

Where:

L=shaft spacing $R_1$=tip radius, and

S=radius measured from rotor rotational axis 500 to arc centers of tip and body surfaces.

Solving Eq. 1 for S yields:

$$S = \sqrt{2}\left(\frac{L}{2} - R_1\right) \quad \text{Eq. 2}$$

As described in more detail below, the geometry and configuration of the fluid flow opening 240 and individual ports 400 in the manifold of the present disclosure are derived from the relationship of the variables representing the geometry and configuration of the rotors 208 as expressed in Eq. 2.

Figure 8:
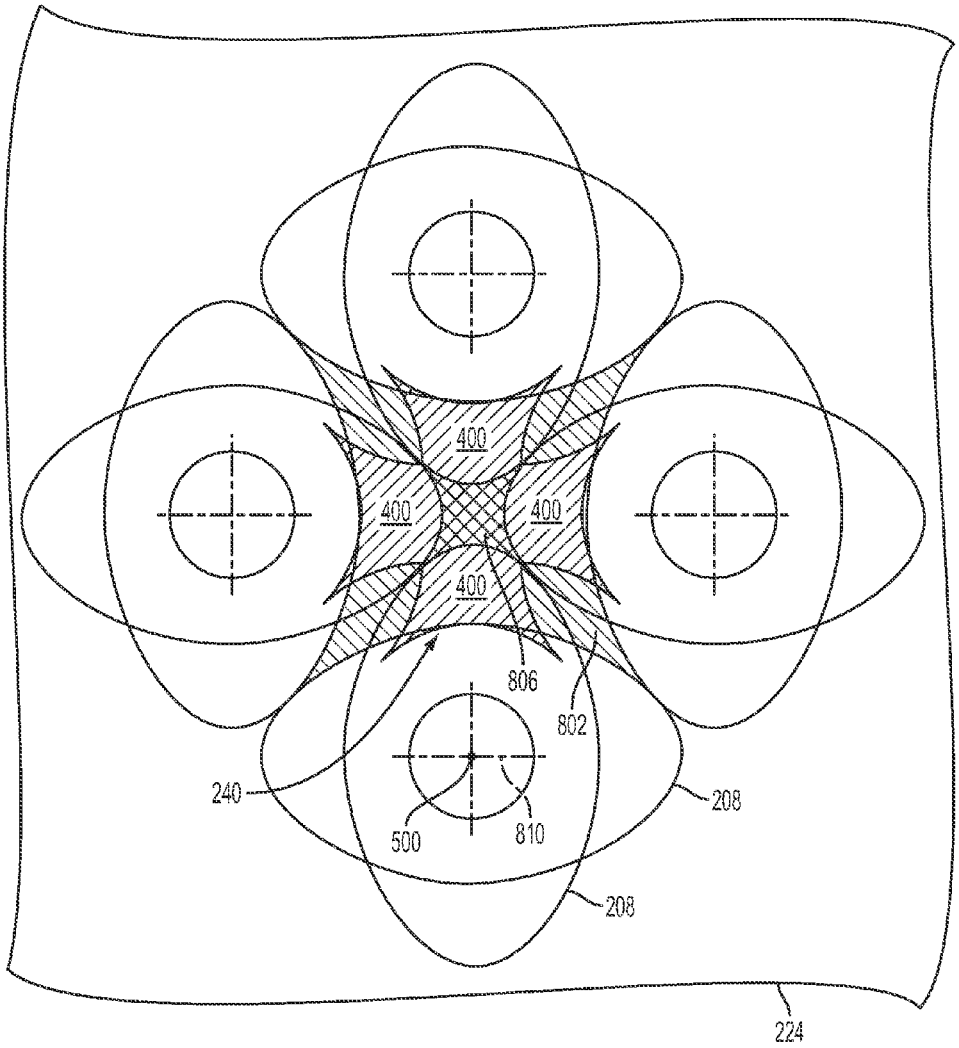
FIG. 8 shows partial cut away end view of the planetary rotor machine of FIG. 2 showing a portion of the head plate that includes the fluid flow opening comprising 4 ports, and showing the 4 rotors in the orientations of FIGS. 6 and 7.
Figure 9:
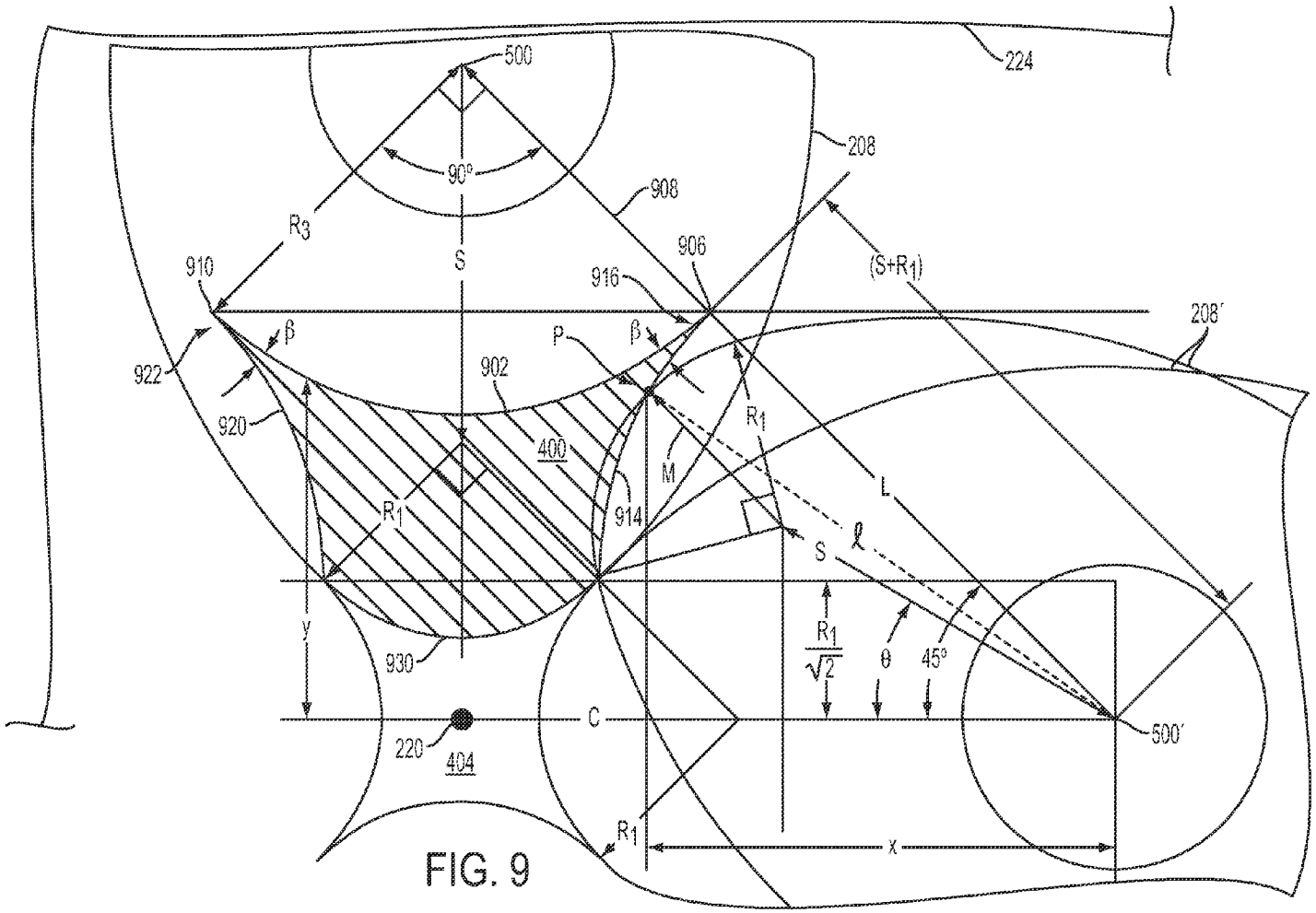
FIG. 9 shows a detailed partial cut away end view, approximately to scale, of the planetary rotor machine of FIG. 2 showing portions of 2 of the 4 rotors and a portion of the head plate, and illustrating one of the ports that comprise the fluid flow opening in the head plate along with the port's geometric relationships to the 2 rotors.

With reference now to FIGS. 8 and 9, the geometry and configuration of one embodiment of the fluid flow opening 240 and associated ports 400, along with their relationship to the rotors 208 of the planetary rotor machine 200, will now be provided. FIG. 8 illustrates the four rotors 208 in the positions of FIGS. 5 and 6 that create the maximum volume of cavity 212, illustrated by shaded area 802 (see also cavity 212 maximum volume shown in FIG. 5), and the minimum volume 806 of cavity 212 (see also FIG. 6), respectively. It will be appreciated that for ease of illustration, the central core 238 is not shown in FIG. 8, but if shown would have substantially the same cross sectional profile as the minimum volume 806 of cavity 212. With reference also to FIG. 4, FIG. 8 also shows the fluid flow opening 240 and associated ports 400 in the head plate 224 of entry manifold 204.

As shown in FIG. 8, each of the four ports 400 corresponds to one of the four helical rotors 208. More particularly and with reference now to FIG. 9, each port 400 takes the shape as illustrated in the shaded area of this figure. In FIG. 9 the port 400 is defined by an inwardly curving inner side 902 that is nearest to the rotor rotational axis 500 of the corresponding rotor 208 and extends between a starting point 906 and an ending point 910. The starting point 906 lies on a line 908 of length L extending between the rotational axis 500 of the rotor 208 to which the port 400 corresponds and the rotational axis 500' of adjacent rotor 208'. The inner side 902 is centered with respect to the corresponding rotor rotational axis 500 and has a radius $R_3$ originating at rotor rotational axis 500, where:

$$R_3=(L-S-R_1) \quad \text{Eq. 3}$$

As shown in FIG. 9, the length of inner side 902 is defined by the 90 degree path swept by radius $R_3$ about rotor rotational axis 500. The port 400 further includes a first lateral arcuate side 914 extending from the starting point 906 of the inner side 902 and forming an acute angle β with the inner side, which angle β increases in a direction toward the machine center axis 220. In this manner, the first lateral arcuate side 914 cooperates with the inner side 902 to form a first pointed notch 916 in the head plate 224. The first lateral arcuate side 914 may be generated graphically by rotation of the adjacent rotor 208' through angle θ as shown in FIG. 9.

More particularly, the curvature and length of the first lateral arcuate side 914 is defined as the locus of points P traced by the rotor tip radius M that extends from the radius S and sweeps from θ=0° to θ=45°, where the radius S originates at the rotational axis 500' of the adjacent rotor 208'. A line C extending through the machine center axis 220 of the planetary rotor machine and the rotational axis 500' of the adjacent rotor 208' corresponds to θ=0°. Rotor tip radius M has a length of $R_1$. For clarity, it will be appreciated that the radius S has a fixed length, whether originating from the rotational axis 500 of the corresponding rotor 208, the rotational axis 500' of the adjacent rotor 208', or from another point. The extremity of rotor tip radius M defines the position of point P for all values between θ=0° and θ=45°.

During the angular sweep of radius S, the rotor tip radius M of length $R_1$ remains angularly stationary and parallel to line 908 connecting rotor rotational axis 500 with rotor rotational axis 500' as shown in FIG. 9. Advantageously, imposing the constraint of constant parallelism of rotor tip radius M to line 908 maintains rotor tip radius M perpendicular to the surface tangents of meshing rotors 208 and 208' at their near-contact meshing point for all rotor angular positions.

Further, such continuous parallelism of rotor tip radius M and line 908 places point P at the rotor meshing point where rotors 208 and 208' abut against the stationary head plate 224 of manifold 204. Alternatively expressed, point P always lies at this rotor meshing point during rotor rotation from θ=0° to θ=45°, and thereby demarks the boundary separating the region exterior from internal cavity 212 and planetary rotor machine 200 at a first pressure from the cavity 212 at a second, different pressure.

Point P may be defined in Cartesian coordinates by points x and y, where:

$$x = \left(S\cos\theta + \frac{R_1}{\sqrt{2}}\right) \quad \text{Eq. 4}$$

$$y = \left(S\sin\theta + \frac{R_1}{\sqrt{2}}\right) \quad \text{Eq. 5}$$

Alternately, Point P may be defined in polar coordinates in terms of radius 1 originating at rotor rotational axis 500' and angle θ. Angle θ ranges from θ=0° and θ=45° and determines the corresponding length and curvature of the first lateral arcuate side 914.

$$l=[S^2+\sqrt{2}R_1S(\cos\theta+\sin\theta)+R_1^2]^{1/2} \quad \text{Eq. 6}$$

Observance of the foregoing Equations 1-6 may produce the largest port cross-sectional area theoretically possible for any given values of $R_1$ and L that prevents fluid bypassing the cavity and escaping around the outside of the rotors. There also exists a particular optimum value of $R_{1\text{-}opt}$ relative to L that yields the largest port area possible relative to maximum cavity cross-sectional area, as discussed below in detail.

With continued reference to FIG. 9, the port 400 includes a second lateral arcuate side 920 extending from the ending point 910 of the inner side 902 and forming an acute angle β with the inner side, which angle β similarly increases in a direction toward the machine center axis 220. In this manner, the second lateral arcuate side 920 also cooperates with the inner side 902 to form a second pointed notch 922 in the head plate 224. As shown in FIG. 9, the second lateral arcuate side 920 is a mirror image of the first lateral arcuate side 914, having the same length as the first lateral arcuate side and forming the same acute angle β with the inner side 902 that increases in a direction toward the machine center axis 220. Similarly, the second pointed notch 922 in the head plate 224 is a mirror image of the first pointed notch 916. With reference also to FIG. 4, it will be appreciated that the inner side 902, first lateral arcuate side 914 and second lateral arcuate side 920 of each port 400 are defined by surface edges of the flat entry head plate 224 of the entry manifold 204.

The port 400 is further defined by an outer side 930 nearest to the machine center axis 220, with such outer side also forming one boundary of the central aperture 404. The outer side 930 is formed by sweeping rotor tip radius $R_1$ through 90° as shown in FIG. 9. Accordingly, each port 400 comprises an inner side 902, first lateral arcuate side 914, second lateral arcuate side 920, and outer side 930 which form the 4-sided aperture illustrated by the shaded area in FIG. 9. With reference also to FIGS. 4 and 8, the four ports 400 and central aperture 404 cooperate to define the fluid flow opening 240.

It will be appreciated that the cross-sectional area $A_{prt}$ of each port 400 is partially dependent on the ratio $R_1/L$, where L is the shaft spacing of adjacent rotors, such as rotors 208 and 208' illustrated in FIG. 9. Thus, as the tip radius $R_1$ increases the area $A_{prt}$ of each port 400 also increases, which in turn reduces flow restrictions into cavity 212. Any given values of $R_1$ and L applied to the above equations may give the theoretical maximum port area possible that prevents fluid from bypassing the cavity and escaping around the rotors. However, there exists a particular optimum value of $R_1$ that yields a maximum port area $A_{prt\text{-}max}$ relative to maximum cavity cross-sectional area. Advantageously, the inventor of the present disclosure has discovered an optimum tip radius $R_{1\text{-}opt}$ yielding the maximum port area $A_{prt\text{-}max}$ relative to maximum cavity cross-sectional area in a 4-rotor machine for a given value of L, which is defined as:

$$R_{1\text{-}opt}=(0.206)L \qquad \text{Eq. 7}$$

With reference again to FIG. 4, the maximum port area $A_{prt\text{-}max}$ corresponds to and is illustrated by the four ports 400 and central aperture 404, while the maximum cavity cross-sectional area is illustrated by the shaded area 802 in FIG. 8 and cavity maximum volume shown in FIG. 5. For descriptive purposes FIG. 8 shows the maximum port area $A_{prt\text{-}max}$ superimposed on maximum cavity area 802. Also and as best seen in FIG. 8, a portion of each port 400 overlaps a portion of the corresponding rotor 208 when a longitudinal axis 810 of the corresponding rotor is orthogonal with respect to a line extending through the rotational axis 500 of the corresponding rotor and the central axis 220 of the planetary rotor machine.

Advantageously, it has been discovered that a planetary rotor machine may include an entry manifold 204 and/or exit manifold 232 with a fluid flow opening utilizing the concepts of the present disclosure and having a maximum port area $A_{prt\text{-}max}$ that is approximately ⅔ of the maximum cavity cross-sectional area of the machine. In this manner and as noted above, the particular shape and geometry of ports 400 and their interrelationship with the geometry and configuration of rotors 208 of the planetary rotor machine enables fluid to flow into the cavity 212 without leaking around the outside of the rotors, while also maximizing the fluid volume flow rate entering the cavity.

As noted above, the principles of the present disclosure may also be utilized in connection with a planetary rotor machine having three rotors that each embodies a 3-lobed rotor design. FIGS. 10-14 illustrate an embodiment of a planetary rotor machine that utilizes three rotors 1000 and includes an embodiment of an entry manifold 1004 for introducing a fluid into the machine at a rotor end/head plate juncture according to the present disclosure. As with the entry manifold 204 and corresponding four-rotor planetary rotor machine described above, the entry manifold 1004 enables fluid to flow into the 3-rotor machine cavity without leaking around the outside of the rotors, while also maximizing the fluid flow volume entering the cavity.

Figure 10:
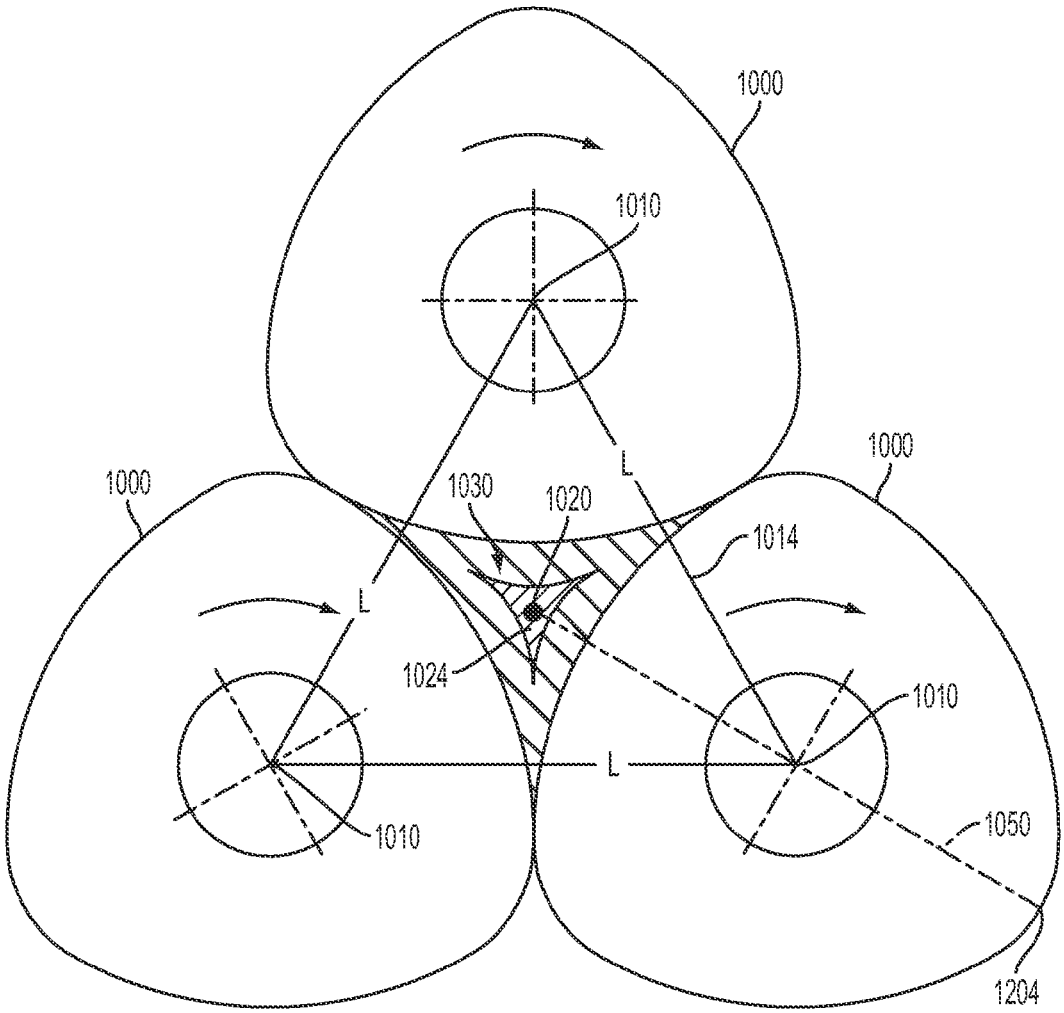
FIG. 10 shows a partial cut away end view of a 3-rotor planetary rotor machine according to another embodiment of the present disclosure, with FIG. 10 showing the head plate of the manifold removed and an orientation of the 3 rotors in which the cavity volume is maximized around a core of the machine.
Figure 12:
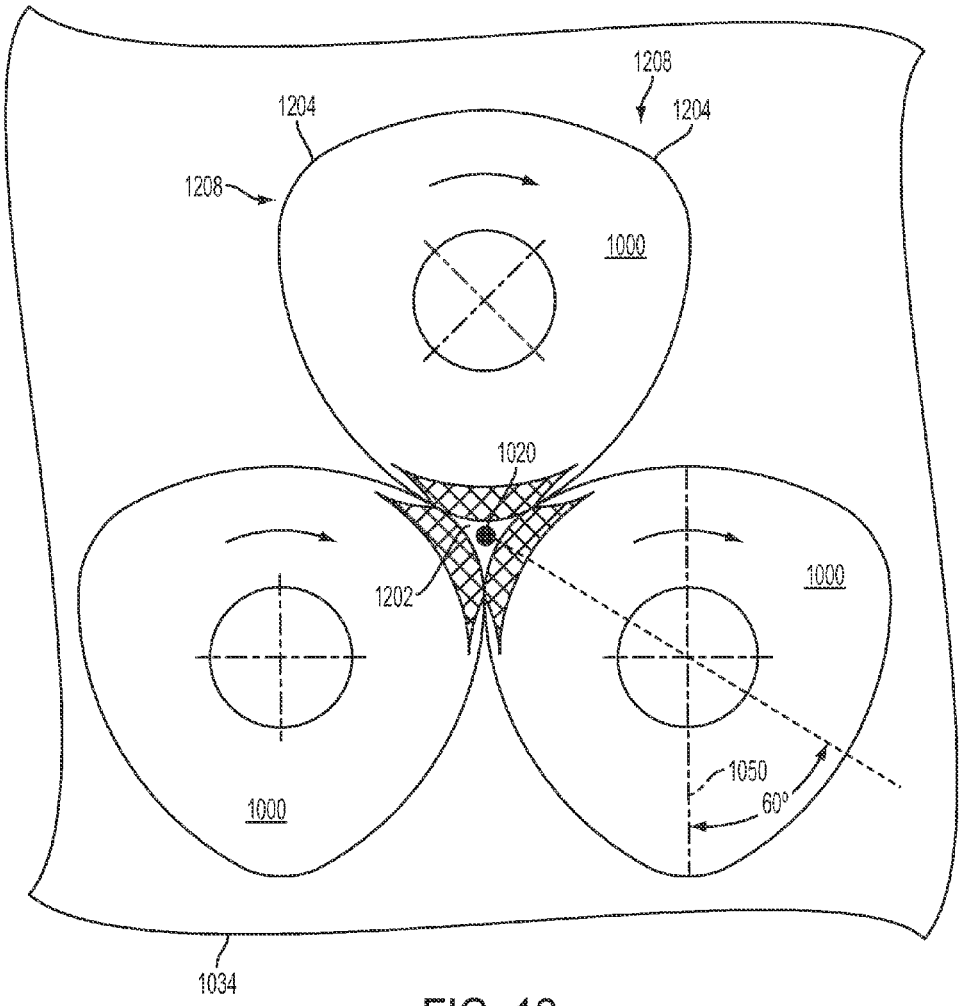
FIG. 12 shows a partial cut away end view of the planetary rotor machine of FIG. 10 showing the portion of the head plate that includes the fluid flow opening comprising the 3 ports, and showing an orientation of the 3 rotors in which the cavity volume is minimized.

With reference to FIG. 10, the rotational axes 1010 of each of the rotors 1000 are positioned at the three corners of an equilateral triangle 1014 having a side length L. The geometric center of the triangle 1014 corresponds to the machine center axis 1020. A solid core 1024 having a curved triangular cross section extends co-axially with the machine center axis 1020 through the cavity 1030 created by the rotors 1000. With reference also to FIG. 12, the core 1024 corresponds to a minimum cavity area that occurs when the tip 1204 of a lobe 1208 of each of the three rotors 1000 is nearest to the machine center axis 1020 as shown in FIG. 12.

Figure 11:
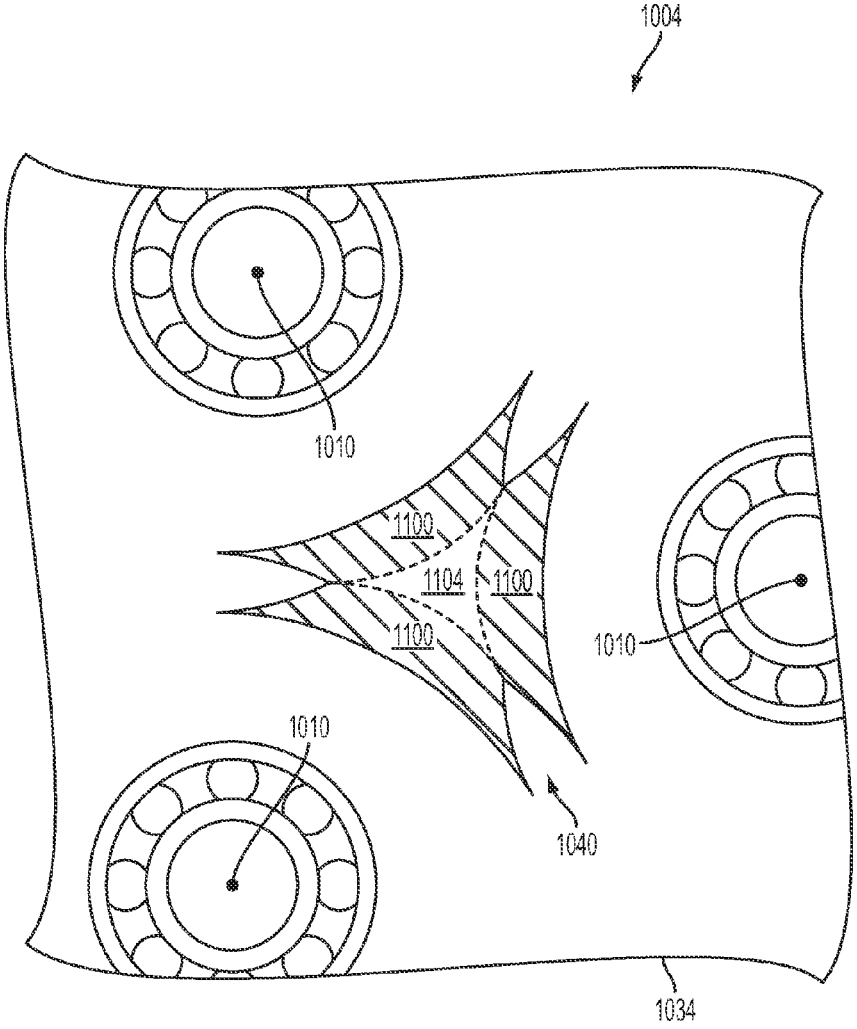
FIG. 11 shows a partial cut away front view of the manifold of the planetary rotor machine of FIG. 10 showing a portion of a head plate that includes a fluid flow opening comprising 3 ports.

With reference now to FIG. 11, a portion of an entry head plate 1034 including a fluid flow opening 1040 is illustrated. As described in more detail below, the fluid flow opening 1040 includes three identically shaped ports 1100 that are located circumferentially around a central aperture 1104 such that each port 1100 corresponds to one of the three helical rotors 1000. The geometric configuration of each port 1100 is mathematically based on the cross-sectional geometry of the three helical rotors 1000 and the relative location of the rotors' rotational axis 1010 around the machine center axis 1020 of the planetary rotor machine. In this manner, each of the three ports 1100 cooperates with the rotors 1000 to substantially prevent fluid from bypassing cavity 1030 while also maximizing fluid flow into the cavity.

Together, the three ports 1100 and central aperture 1104 comprise the fluid flow opening 1040 in the head plate 1034 of the entry manifold 1004. It will also be appreciated that the cross-sectional profile of the central aperture 1104 approximately matches the cross-sectional profile of the core 1024. In this manner and in some embodiments, an axial end of the core 1024 may be received within the central aperture 1104 of the fluid flow opening 1040 and may be flush with an outer surface of the head plate 1034.

It will be appreciated that in some embodiments of a 3-rotor planetary rotor machine, an exit manifold may have the same configuration as the entry manifold 1004. In other embodiments, the exit manifold may have a configuration different from the entry manifold 1004.

FIG. 10 illustrates an orientation of the three rotors 1000 that creates a maximum cross-sectional area of cavity 1030. Such an orientation occurs when a rotor tip axis 1050 of each rotor 1000 extends from the rotor lobe tip 1204 through the rotor rotational axis 1010 and through the machine center axis 1020. By contrast, FIG. 12 illustrates an orientation of the three rotors 1000 that creates a minimum cross-sectional area of cavity 1030, illustrated by triangular area 1202. Such an orientation occurs when the rotor tip axis 1050 of each rotor 1000 is rotated by 60° from the orientation shown in FIG. 10.

Figure 13:
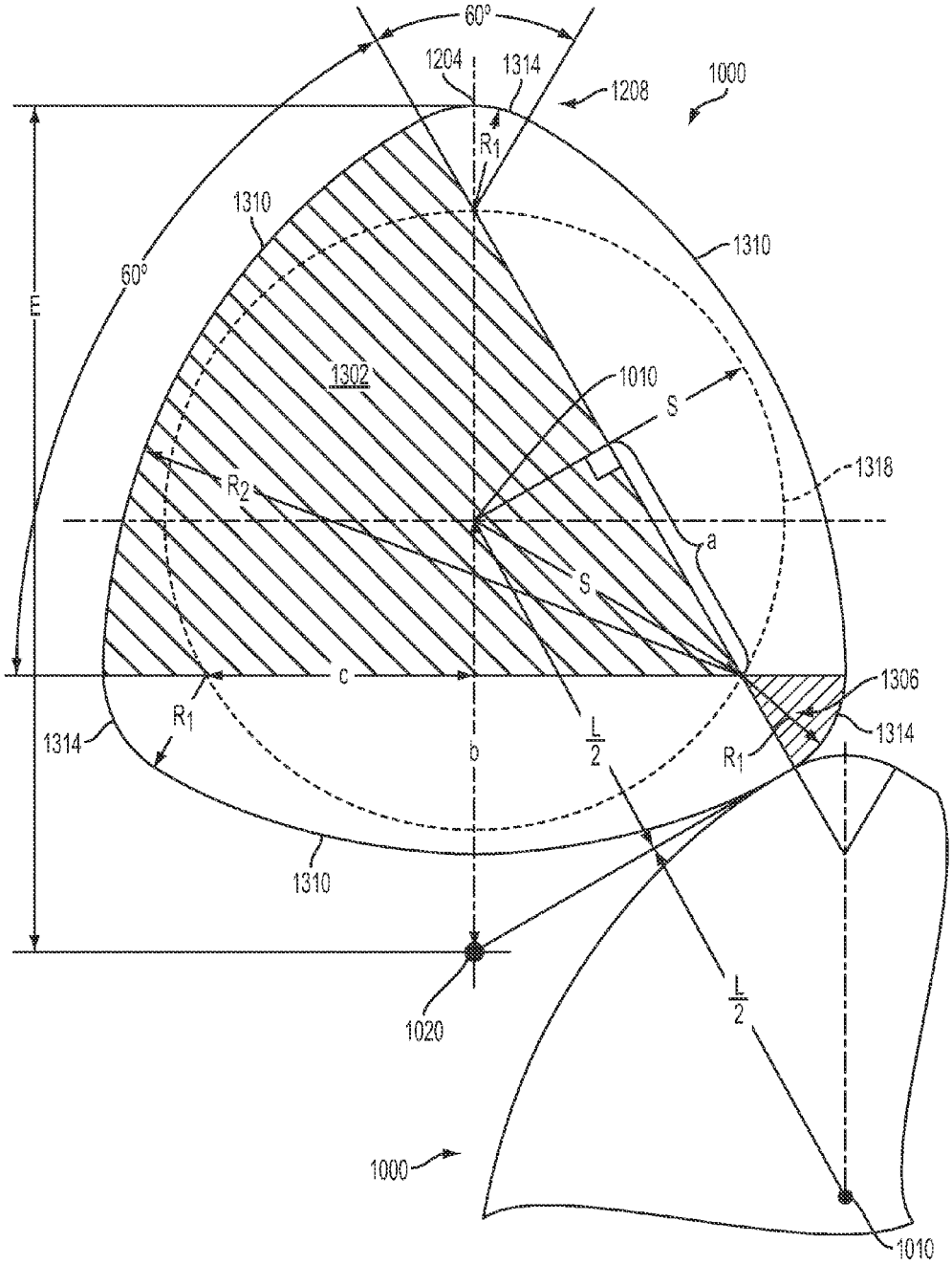
FIG. 13 shows a transverse cross-sectional view, approximately to scale, of one of the 3-lobed rotors of the 3-rotor planetary rotor machine of FIG. 10 and a portion of an adjacent rotor.
Figure 14:
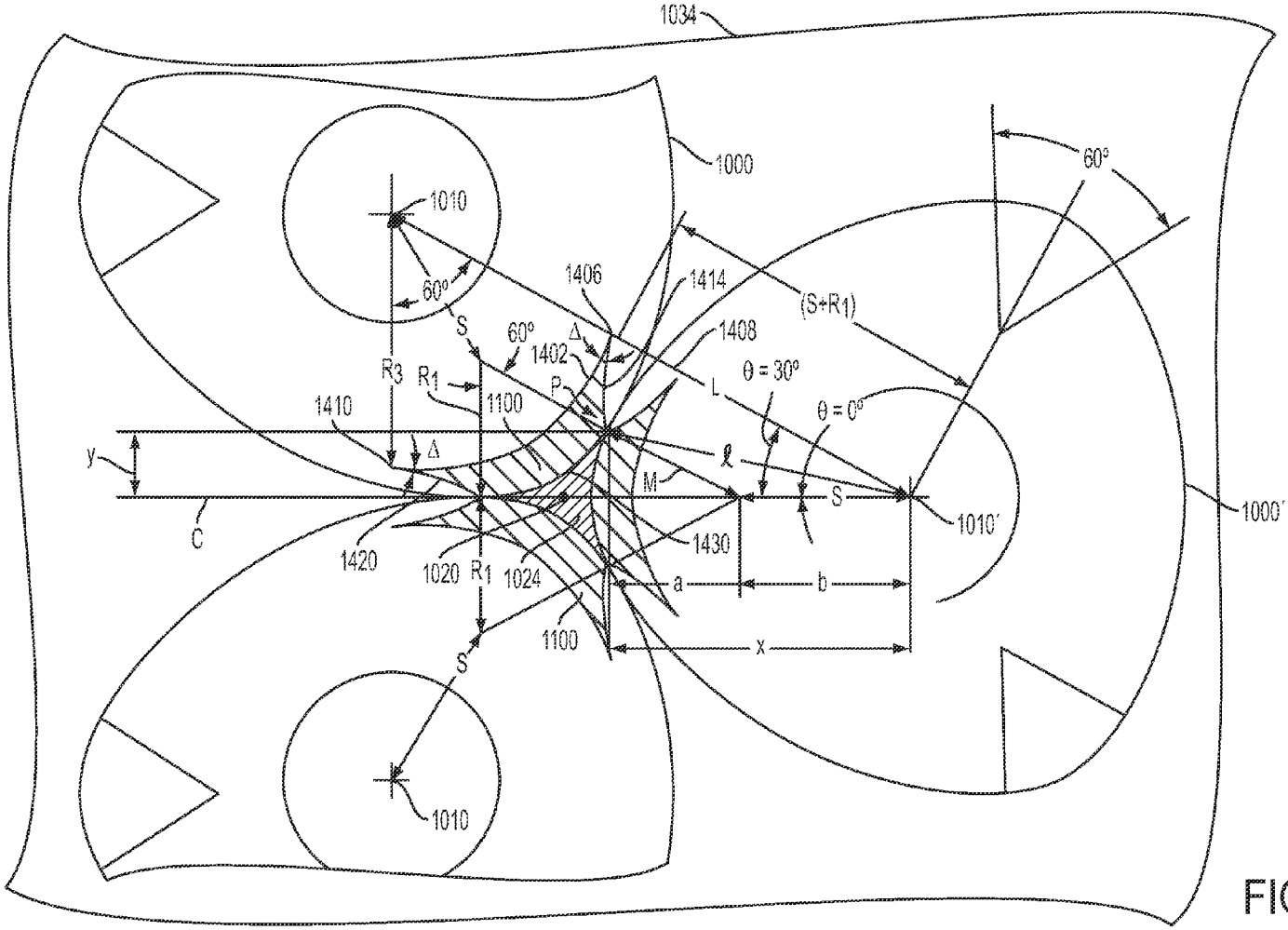
FIG. 14 shows a detailed partial cut away end view of the planetary rotor machine of FIG. 10 showing the 3 rotors and a portion of the head plate, and illustrating the opening comprising the 3 ports in the head plate along with the ports' geometric relationships to the 3 rotors.

With reference now to FIGS. 13 and 14, a description of the lobe tips 1204 and body geometry of each 3-lobed rotor 1000 will now be provided. As noted above, it will be appreciated that the basic principles of rotor and port design of the present disclosure apply to 3-lobed rotors in a 3-rotor planetary rotor machine as well as to 2-lobed rotors in a 4-rotor planetary rotor machine as described above. More particularly and as described in more detail below, the geometry and configuration of the three ports 1100 are mathematically related to the geometry and configuration of the three rotors 1000 in a similar manner as the geometry and configuration of the four ports 400 are mathematically related to the geometry and configuration of the four rotors 208 in the 4-rotor planetary rotor machine embodiment discussed above.

As best seen in FIG. 13, the cross sectional profile of each rotor 1000 consists of six 60° segments that include three 60° segments of small tip radius $R_1$ and three 60° segments of large body radius $R_2$. For clarity of illustration only one large body radius $R_2$ is shown. Body segments that are defined by large body radius $R_2$ and tip segments that are defined by small tip radius $R_1$ alternate at 60° intervals. One body segment 1302 and one tip segment 1306 are shown shaded in FIG. 13.

As shown also in FIG. 14, the rotor rotational axes 1010 of the rotors 1000 are spaced by a distance L. The circular arcs defining the body surface 1310 of each body segment and the tip surface 1314 of each tip segment have their radii (body radius $R_2$ and tip radius $R_1$) originating from the dotted circle 1318 of radius S that is concentric to the rotor rotational axis 1010. As shown in FIG. 13, tip radii $R_1$ and body radii $R_2$ for opposing tip surfaces 1314 and body surfaces 1310 share the same origin on the dotted circle 1318 of radius S. More particularly, such tip radii $R_1$ and body radii $R_2$ originate at 12:00, 4:00 and 8:00 positions on the dotted circle 1318.

The relationship among the parameters $R_1$, $R_2$, L, and S for a 3-lobed rotor 1000 is expressed by the following equations:

$$L = R_1 + R_2 \quad \text{Eq. 8}$$

$$L = \left(S\sqrt{3} + 2R_1\right) \quad \text{Eq. 9}$$

$$S = \frac{(L - 2R_1)}{\sqrt{3}} \quad \text{Eq. 10}$$

$$R_2 = \frac{\sqrt{3}}{2}(E - R_1), \quad \text{Eq. 11}$$

where E=an envelope radius of the 3-lobed planetary rotor machine. An envelope radius is defined as the distance between the machine center axis 1020 and the outermost point from the machine center axis that is swept by the tip surfaces 1314.

With reference now to FIGS. 11 and 14, each of the 3 ports 1100 corresponds to one of the 3 helical rotors 1000. More particularly and as shown in FIG. 11, each port 1100 takes the shape as illustrated in the shaded areas of this figure. As best seen in FIG. 14, each port 1100 is defined by an inwardly curving inner side 1402 that is nearest to the rotor rotational axis 1010 of the corresponding rotor 1000. The inwardly curving inner side 1402 extends between a starting point 1406 and an ending point 1410. The starting point 1406 lies on the line 1408 of length L extending between the rotational axis 1010 of the rotor 1000 to which the port 1100 corresponds and the rotational axis 1010' of adjacent rotor 1000'. The inner side 1402 is centered with respect to the corresponding rotor rotational axis 1010 and has a radius $R_3$ originating at rotor rotational axis 1010, where:

$$R_3=(L-S-R_1) \quad \text{Eq. 3}$$

As shown in FIG. 14, the length of inner side 1402 is defined by the 60 degree path swept by radius $R_3$ about rotor rotational axis 1010. The port 1100 further includes a first lateral arcuate side 1414 extending from the starting point 1406 of the inner side 1402 and forming an acute angle Δ with the inner side, which angle Δ increases in a direction toward the machine center axis 1020. The first lateral arcuate side 1414 may be generated graphically by rotation of the adjacent rotor 1000' through angle θ=30° as shown in FIG. 14.

More particularly, the curvature of the first lateral arcuate side 1414 is defined as the locus of points P traced by the rotor tip radius M that extends from the radius S and sweeps from θ=0° to θ=30°, and where the radius S originates at the rotational axis 1010' of the adjacent rotor 1000'. Rotor tip radius M has a length of $R_1$. A line C extending through the machine center axis 1020 and the rotational axis 1010' of the adjacent rotor 1000' corresponds to θ=0°. For clarity, it will be appreciated that the radius S has a fixed length, whether originating from the rotational axis 1010 of the corresponding rotor 1000, the rotational axis 1010' of the adjacent rotor 1000', or from another point. The extremity of rotor tip radius M defines the position of point P for all values between θ=0° and θ=30°.

During the angular sweep of radius S, the tip radius M remains angularly stationary and parallel to line 1408 connecting rotor rotational axis 1010 with rotor rotational axis 1010' as shown in FIG. 14. Advantageously, imposing the constraint of constant parallelism of tip radius M to line 1408 maintains tip radius M perpendicular to the surface tangents of meshing rotors 1000 and 1000' at their near-contact meshing point for all rotor angular positions.

Point P may be defined in Cartesian coordinates by points x and y, where:

$$x = (b + a) = \left(S\cos\theta + \frac{\sqrt{3}}{2}R_1\right) \quad \text{Eq. 12}$$

$$y = \left(S\sin\theta + \frac{R_1}{2}\right) \quad \text{Eq. 13}$$

Alternatively, point P may be defined in polar coordinates in terms of radius l originating at rotor rotational axis 1010' and angle θ. As noted above, angle θ ranges from θ=0° and θ=30° and determines the corresponding length and curvature of the first lateral arcuate side 1414.

$$l = \left[S^2 + \left(\sqrt{3}\cos\theta + \sin\theta\right)R_1S + R_1^2\right]^{1/2} \quad \text{Eq. 14}$$

The radius S for a 3-rotor planetary rotor machine may be expressed in terms of L, the distance between adjacent rotor rotational axes 1010 and 1010':

$$S = \frac{(L - 2R_1)}{\sqrt{3}} \quad \text{Eq. 15}$$

Advantageously, it will be appreciated that the relationships expressed by the foregoing equations define port boundaries that may enclose the theoretical maximum cross-sectional area of port 1100 for any given values of L and $R_1$ while preventing fluid from bypassing the cavity and flowing around the outside of the rotors.

With continued reference to FIG. 14, the port 1100 includes a second lateral arcuate side 1420 extending from the ending point 1410 of the inner side 1402 and forming acute angle Δ with the inner side 1402, which angle Δ similarly increases in a direction toward the machine center axis 220. As shown in FIG. 14, the second lateral arcuate side 1420 is a mirror image of the first lateral arcuate side 1414, having the same length as the first lateral arcuate side and forming the same acute angle Δ with the inner side 902 that increases in a direction toward the machine center axis 220.

The port 1100 is further defined by an outer side 1430 nearest to the machine center axis 1020, with such outer side also forming one side of the central aperture 1104 (see also FIG. 11). The outer side 1430 is formed by sweeping rotor tip radius $R_1$ that extends from radius S originating at rotational axis 1010 through 60° as shown in FIG. 14. Accordingly, each port 1100 comprises an inner side 1402, first lateral arcuate side 1414, second lateral arcuate side 1420, and outer side 1430 forming the four-sided aperture illustrated in FIG. 14. With reference also to FIG. 11, the three ports 1100 and central aperture 1104 cooperate to define the fluid flow opening 1040.

As with the four-lobed rotors discussed above, it will be appreciated that the cross-sectional area $A_{prt}$ of each port 1100 is partially dependent on the ratio $R_1/L$. Thus, as the tip radius $R_1$ increases the area $A_{prt}$ of each port 1100 also increases, which in turn reduces flow restrictions into the cavity of the 3-rotor machine. The foregoing equations define port boundaries that may enclose the theoretical maximum cross-sectional area of port 1100 for any given values of S and $R_1$. However, as described above for the 2-lobed rotors, there exists a particular optimum value of $R_1$ for 3-lobed rotors that gives a maximum port area relative to the maximum cavity cross-sectional area.

Advantageously and by utilizing the concepts of the present disclosure, a three-rotor planetary rotor machine may include an entry manifold with a fluid flow opening having a port area $A_{prt}$ that represents the theoretical maximum area that prevents fluid from bypassing the cavity. In this manner and as noted above, the particular shape of ports 1100 and their interrelationship with the geometry and configuration of rotors 1000 of the planetary rotor machine enables fluid to flow into the cavity without leaking around the outside of the rotors, while also maximizing the volume flow rate entering the cavity.

It will be appreciated that references to "one embodiment" or "an embodiment" are not intended to be interpreted as excluding the existence of additional embodiments that also incorporate the recited features. Unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects. The term "adjacent" is used to mean that a first element or structure is nearby or in close proximity to a second element or structure, and includes the first and second elements or structures being in contact and not in contact.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A manifold for a planetary rotor machine including a plurality of helical rotors for compressing or expanding a fluid, the manifold comprising:

a head plate to which each of the rotors is rotatably mounted, the head plate including a fluid flow opening having a center coaxial with a central axis of the planetary rotor machine, the fluid flow opening comprising a plurality of ports with each of the ports corresponding to one of the rotors, wherein each of the ports comprises:

an inwardly curving inner side extending between a starting point and an ending point;

a first lateral arcuate side extending from the starting point of the inner side and together with the inner side forming a first pointed notch in the head plate; and a second lateral arcuate side extending from the ending point of the inner side and together with the inner side forming a second pointed notch in the head plate, wherein the second lateral arcuate side is a mirror image of the first lateral arcuate side, wherein the manifold substantially prevents the fluid from bypassing a cavity created by the rotors.

2. The manifold of claim 1, wherein the inwardly curving inner side has an inner radius R3 that extends from a rotational axis of the corresponding rotor, and wherein the inner radius R3 is a function of a distance L between the rotational axis of the corresponding rotor and a rotational axis of an adjacent rotor.

3. The manifold of claim 2, wherein each of the rotors has a rotor tip radius R1, and the inner radius R3 is also a function of the rotor tip radius R1.

4. The manifold of claim 3, wherein the inner radius R3 is also a function of a circle radius S that extends from the rotational axis of the corresponding rotor, and wherein the circle radius S defines a circle upon which the rotor tip radius R1 of the corresponding rotor and a body radius R2 of the corresponding rotor originate.

5. The manifold of claim 4, wherein R3=(L−S−R1).

6. The manifold of claim 4, wherein the first lateral arcuate side has a curvature traced by a rotor tip radius M extending from the circle radius S that extends from a rotational axis of the adjacent rotor.

7. The manifold of claim 6, wherein a length of the curvature of the first lateral arcuate side is determined by a locus of points P traced by the rotor tip radius M as the circle radius S that extends from the rotational axis of the adjacent rotor sweeps from θ=0 degrees to θ=X degrees, wherein X=45 where the planetary rotor machine includes 4 rotors, and X=30 where the planetary rotor machine includes 3 rotors.

8. A manifold for introducing a fluid into or discharging a fluid from a planetary rotor machine, the planetary rotor machine comprising 4 helical rotors that create a cavity for compressing or expanding the fluid, the manifold comprising:

a head plate including a fluid flow opening having a center coaxial with a central axis of the planetary rotor machine, the fluid flow opening comprising 4 ports that each correspond to one of the rotors, wherein each of the ports comprises:

an inwardly curving inner side extending between a starting point and an ending point;

a first lateral arcuate side extending from the starting point of the inner side and forming an acute angle with the inner side; and a second lateral arcuate side extending from the ending point of the inner side and forming an acute angle with the inner side, wherein the second lateral arcuate side is a mirror image of the first lateral arcuate side;

wherein the manifold substantially prevents the fluid from bypassing the cavity created by the rotors.

9. The manifold of claim 8, wherein the inner side has an inner radius R3 that extends from a rotational axis of the corresponding rotor, and wherein the inner radius R3 is a function of a distance L between the rotational axis of the corresponding rotor and a rotational axis of an adjacent rotor.

10. The manifold of claim 9, wherein each of the rotors has a rotor tip radius R1, and the inner radius R3 is also a function of the rotor tip radius R1.

11. The manifold of claim 10, wherein the inner radius R3 is also a function of a circle radius S that extends from the rotational axis of the corresponding rotor, and wherein the circle radius S defines a circle upon which the rotor tip radius R1 of the corresponding rotor and a body radius R2 of the corresponding rotor originate.

12. The manifold of claim 11, wherein R3=(L−S−R1).

13. The manifold of claim 11, wherein the first lateral arcuate side comprises a curvature traced by a rotor tip radius M extending from the circle radius S that extends from a rotational axis of the adjacent rotor.

14. The manifold of claim 13, wherein the second lateral arcuate side comprises a curvature traced by the rotor tip radius M extending from the circle radius S that extends from a rotational axis of another of the rotors that is opposite to the adjacent rotor.

15. The manifold of claim 13, wherein a length of the curvature of the first lateral arcuate side is determined by a locus of points P traced by the rotor tip radius M as the circle radius S that extends from the rotational axis of the adjacent rotor sweeps from θ=0 degrees to θ=45 degrees.

16. The manifold of claim 8, wherein a portion of each port overlaps a portion of the corresponding rotor when a longitudinal axis of the corresponding rotor is orthogonal with respect to a line extending through a rotational axis of the corresponding rotor and the central axis of the planetary rotor machine.

17. A planetary rotor machine for compressing or expanding a fluid, the planetary rotor machine comprising:

a core extending along a central axis of the planetary rotor machine and coaxial with the central axis;

a plurality of helical rotors positioned around the core, the helical rotors creating a cavity around the core in which the fluid travels; and a manifold for introducing the fluid into the cavity or discharging the fluid from the cavity, the manifold comprising:

a head plate including a fluid flow opening having a center coaxial with the central axis of the planetary rotor machine, the fluid flow opening comprising a plurality of ports with each of the ports corresponding to one of the helical rotors, wherein each of the ports comprises:

an inwardly curving inner side extending between a starting point and an ending point;

a first lateral arcuate side extending from the starting point of the inner side and forming an acute angle with the inner side; and a second lateral arcuate side extending from the ending point of the inner side and forming an acute angle with the inner side, wherein the second lateral arcuate side is a mirror image of the first lateral arcuate side, wherein the manifold substantially prevents the fluid from bypassing the cavity created by the rotors.

18. The planetary rotor machine of claim 17, wherein the inner side has an inner radius R3 that extends from a rotational axis of the corresponding rotor, and wherein the inner radius R3 is a function of a distance L between the rotational axis of the corresponding rotor and a rotational axis of an adjacent rotor.

19. The planetary rotor machine of claim 18, wherein each of the rotors has a rotor tip radius R1, and the inner radius R3 is also a function of the rotor tip radius R1.

20. The planetary rotor machine of claim 19, wherein the inner radius R3 is also a function of a circle radius S that extends from the rotational axis of the corresponding rotor, and wherein the circle radius S defines a circle upon which the rotor tip radius R1 of the corresponding rotor and a body radius R2 of the corresponding rotor originate.

* * * * *